US008401414B2

(12) United States Patent
Yoshikawa et al.

(10) Patent No.: US 8,401,414 B2
(45) Date of Patent: Mar. 19, 2013

(54) FIXING DEVICE AND IMAGE FORMING APPARATUS INCORPORATING SAME

(75) Inventors: Masaaki Yoshikawa, Tokyo (JP); Yoshiki Yamaguchi, Sagamihara (JP); Toshihiko Shimokawa, Zama (JP); Kenji Ishii, Kawasaki (JP); Naoki Iwaya, Choufu (JP); Takahiro Imada, Yokohama (JP); Yutaka Ikebuchi, Chigasaki (JP); Takamasa Hase, Kawasaki (JP); Tetsuo Tokuda, Kawasaki (JP); Hiroshi Yoshinaga, Ichikawa (JP); Kenichi Hasegawa, Atsugi (JP); Ippei Fujimoto, Ebina (JP); Akira Shinshi, Machida (JP)

(73) Assignee: Ricoh Company, Ltd., Tokyo (JP)

( * ) Notice: Subject to any disclaimer, the term of this patent is extended or adjusted under 35 U.S.C. 154(b) by 177 days.

(21) Appl. No.: 12/857,953

(22) Filed: Aug. 17, 2010

(65) Prior Publication Data

US 2011/0052237 A1 Mar. 3, 2011

(30) Foreign Application Priority Data

Sep. 3, 2009 (JP) ..... 2009-203497
May 7, 2010 (JP) ..... 2010-107357

(51) Int. Cl.
*G03G 15/20* (2006.01)

(52) U.S. Cl. ..... 399/69; 219/216; 399/329

(58) Field of Classification Search ..... 399/329, 399/328, 69; 219/216, 617, 671
See application file for complete search history.

(56) References Cited

U.S. PATENT DOCUMENTS

| | | | | |
|---|---|---|---|---|
| 7,702,271 | B2 | 4/2010 | Yamada et al. | 399/327 |
| 2004/0129697 | A1 | 7/2004 | Suzuki | 219/619 |
| 2005/0265758 | A1 | 12/2005 | Haseba et al. | 399/329 |

(Continued)

FOREIGN PATENT DOCUMENTS

| | | | |
|---|---|---|---|
| CN | 1704854 | A | 12/2005 |
| CN | 101059679 | A | 10/2007 |

(Continued)

OTHER PUBLICATIONS

Office Action issued Apr. 25, 2012 in Chinese Patent Application No. 201010264071.4.

(Continued)

*Primary Examiner* — Sophia S Chen
(74) *Attorney, Agent, or Firm* — Oblon, Spivak, McClelland, Maier & Neustadt, L.L.P.

(57) ABSTRACT

In a fixing device, a pressing member rotates in a predetermined direction of rotation. A flexible endless fixing member rotates in accordance with rotation of the pressing member. A nip formation member is provided inside a loop formed by the fixing member and pressed against the pressing member via the fixing member to form a nip between the fixing member and the pressing member through which a recording medium bearing a toner image passes. A first heat generator faces an inner circumferential surface of the fixing member at a position other than the nip to heat the fixing member. A second heat generator faces the inner circumferential surface of the fixing member at a position other than the nip to heat the fixing member, and is disposed adjacent to the first heat generator along the inner circumferential surface of the fixing member.

16 Claims, 5 Drawing Sheets

U.S. PATENT DOCUMENTS

| | | | | |
|---|---|---|---|---|
| 2007/0242989 | A1 | 10/2007 | Miyake | 399/328 |
| 2007/0292175 | A1 | 12/2007 | Shinshi | 399/329 |
| 2008/0112739 | A1 | 5/2008 | Shinshi | 399/329 |
| 2008/0175633 | A1 | 7/2008 | Shinshi | 399/329 |
| 2008/0219730 | A1 | 9/2008 | Shinshi | 399/333 |
| 2008/0298862 | A1 | 12/2008 | Shinshi | 399/324 |
| 2008/0304882 | A1 | 12/2008 | Shin et al. | 399/329 |
| 2009/0148204 | A1 | 6/2009 | Yoshinaga et al. | 399/328 |
| 2009/0148205 | A1 | 6/2009 | Seo et al. | 399/330 |
| 2009/0162116 | A1 | 6/2009 | Mogi et al. | 399/329 |
| 2009/0169232 | A1 | 7/2009 | Kunii et al. | 399/70 |
| 2009/0245865 | A1 | 10/2009 | Shinshi et al. | |
| 2009/0245897 | A1 | 10/2009 | Seo et al. | 399/328 |
| 2009/0297197 | A1 | 12/2009 | Hase | |
| 2009/0311016 | A1 | 12/2009 | Shinshi | 399/329 |
| 2010/0061753 | A1 | 3/2010 | Hase | 399/69 |
| 2010/0074667 | A1 | 3/2010 | Ehara et al. | |
| 2010/0086324 | A1* | 4/2010 | Smith | 399/329 X |
| 2010/0092220 | A1 | 4/2010 | Hasegawa et al. | |
| 2010/0092221 | A1 | 4/2010 | Shinshi et al. | 399/330 |
| 2010/0202809 | A1 | 8/2010 | Shinshi et al. | 399/329 |
| 2010/0290822 | A1 | 11/2010 | Hasegawa et al. | |
| 2010/0303521 | A1 | 12/2010 | Ogawa et al. | |
| 2010/0303527 | A1* | 12/2010 | Mitsuoka | 399/329 |
| 2011/0013950 | A1 | 1/2011 | Furuya et al. | |
| 2011/0026987 | A1 | 2/2011 | Hasegawa | |
| 2011/0026988 | A1 | 2/2011 | Yoshikawa et al. | |

FOREIGN PATENT DOCUMENTS

| | | | |
|---|---|---|---|
| JP | 9-26715 | | 1/1997 |
| JP | 10-213984 | | 8/1998 |
| JP | 2884714 | | 2/1999 |
| JP | 3298354 | | 4/2002 |
| JP | 2003-7447 | | 1/2003 |
| JP | 2003-228249 | A * | 8/2003 |
| JP | 2003-287970 | | 10/2003 |
| JP | 2007-334205 | | 12/2007 |
| JP | 2008-146010 | | 6/2008 |
| JP | 2008-158482 | | 7/2008 |
| JP | 2008-216928 | | 9/2008 |
| JP | 2009-3410 | | 1/2009 |

OTHER PUBLICATIONS

Extended European Search Report issued Nov. 26, 2010, in European Patent Application No. 10173643.7.

Chinese Office Action for Chinese Patent Application No. 201010264071.4, dated Jan. 10, 2013.

* cited by examiner

FIXING DEVICE AND IMAGE FORMING APPARATUS INCORPORATING SAME

CROSS-REFERENCE TO RELATED APPLICATIONS

The present application is based on and claims priority to Japanese Patent Application Nos. 2009-203497, filed on Sep. 3, 2009, and 2010-107357, filed on May 7, 2010, in the Japan Patent Office, each of which is hereby incorporated herein by reference in its entirety.

BACKGROUND OF THE INVENTION

1. Field of the Invention

Exemplary aspects of the present invention relate to a fixing device and an image forming apparatus, and more particularly, to a fixing device for fixing a toner image on a recording medium and an image forming apparatus including the fixing device.

2. Description of the Related Art

Related-art image forming apparatuses, such as copiers, facsimile machines, printers, or multifunction printers having at least one of copying, printing, scanning, and facsimile functions, typically form an image on a recording medium according to image data. Thus, for example, a charger uniformly charges a surface of an image carrier; an optical writer emits a light beam onto the charged surface of the image carrier to form an electrostatic latent image on the image carrier according to the image data; a development device supplies toner to the electrostatic latent image formed on the image carrier to make the electrostatic latent image visible as a toner image; the toner image is directly transferred from the image carrier onto a recording medium or is indirectly transferred from the image carrier onto a recording medium via an intermediate transfer member; a cleaner then cleans the surface of the image carrier after the toner image is transferred from the image carrier onto the recording medium; finally, a fixing device applies heat and pressure to the recording medium bearing the toner image to fix the toner image on the recording medium, thus forming the image on the recording medium.

Such fixing device may include a fixing belt or a fixing film to apply heat to the recording medium bearing the toner image. FIG. 1 is a sectional view of a fixing device 20R1 including a fixing belt 204. The fixing belt 204 is looped around a heating roller 202 and a fixing roller 203. A pressing roller 205 presses against the fixing roller 203 via the fixing belt 204 to form a fixing nip N between the pressing roller 205 and the fixing belt 204. The fixing belt 204 is heated by a heater 201 provided inside the heating roller 202. As a recording medium P bearing a toner image passes between the fixing belt 204 and the pressing roller 205, the fixing belt 204 and the pressing roller 205 apply heat and pressure to the recording medium P bearing the toner image to fix the toner image on the recording medium P.

However, the heating roller 202 has a relatively large heat capacity, resulting in a longer warm-up time of the fixing device 20R1.

To address this problem, the fixing device may include a fixing film having a relatively small heat capacity. FIG. 2 is a sectional view of a fixing device 20R2 including a fixing film 213. A pressing roller 212 presses against a ceramic heater 211 provided inside the fixing film 213 via the fixing film 213 to foam a fixing nip N between the pressing roller 212 and the fixing film 213. As a recording medium bearing a toner image passes between the pressing roller 212 and the fixing film 213, the fixing film 213 heated by the ceramic heater 211 and the pressing roller 212 apply heat and pressure to the recording medium bearing the toner image to fix the toner image on the recording medium.

However, the fixing film 213 has a drawback in that sliding over the ceramic heater 211 increases friction between the fixing film 213 and the ceramic heater 211 over time, resulting in unstable movement of the fixing film 213 and increased driving torque of the fixing device 20R2. Further, the rotating fixing film 213 is heated by the ceramic heater 211 at the fixing nip N only, and therefore the fixing film 213 is at its lowest temperature just before the fixing nip N in a direction of rotation of the fixing film 213, generating faulty fixing due to low temperature at the fixing nip N when the fixing film 213 is rotated at high speed.

To address the above-described problems, the fixing device may include a resistance heat generator provided inside a fixing belt, with a slight gap between the resistance heat generator and the fixing belt. However, when the fixing belt rotates, slack appears in the fixing belt downstream from the fixing nip in a direction of rotation of the fixing belt, widening the gap between the resistance heat generator and the fixing belt. The wider gap may delay heat transmission from the resistance heat generator to the fixing belt, and therefore the temperature of the resistance heat generator may increase abnormally at the downstream position.

BRIEF SUMMARY OF THE INVENTION

This specification describes below an improved fixing device. In one exemplary embodiment of the present invention, the fixing device includes a pressing member, a flexible endless fixing member, a nip formation member, a first heat generator, and a second heat generator. The pressing member rotates in a predetermined direction of rotation. The fixing member rotates in accordance with rotation of the pressing member. The nip formation member is provided inside a loop formed by the fixing member and pressed against the pressing member via the fixing member to form a nip between the fixing member and the pressing member through which a recording medium bearing a toner image passes. The first heat generator faces an inner circumferential surface of the fixing member at a position other than the nip to heat the fixing member. The second heat generator faces the inner circumferential surface of the fixing member at a position other than the nip to heat the fixing member, and is disposed adjacent to the first heat generator along the inner circumferential surface of the fixing member.

This specification further describes below an image forming apparatus. In one exemplary embodiment, the image forming apparatus includes an image forming device that forms a toner image on a recording medium and the fixing device described above.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
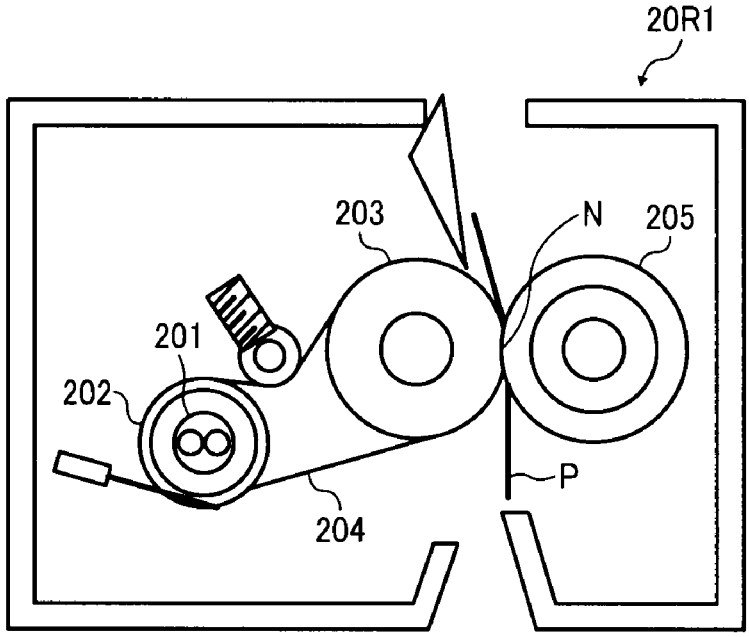
FIG. 1 RELATED ART
FIG. 1 is a sectional view of a related-art fixing device.
Figure 2:
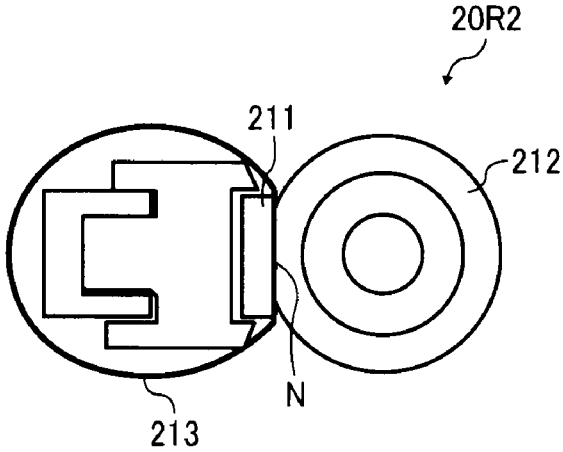
FIG. 2 RELATED ART
FIG. 2 is a sectional view of another related-art fixing device.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Figure 3:
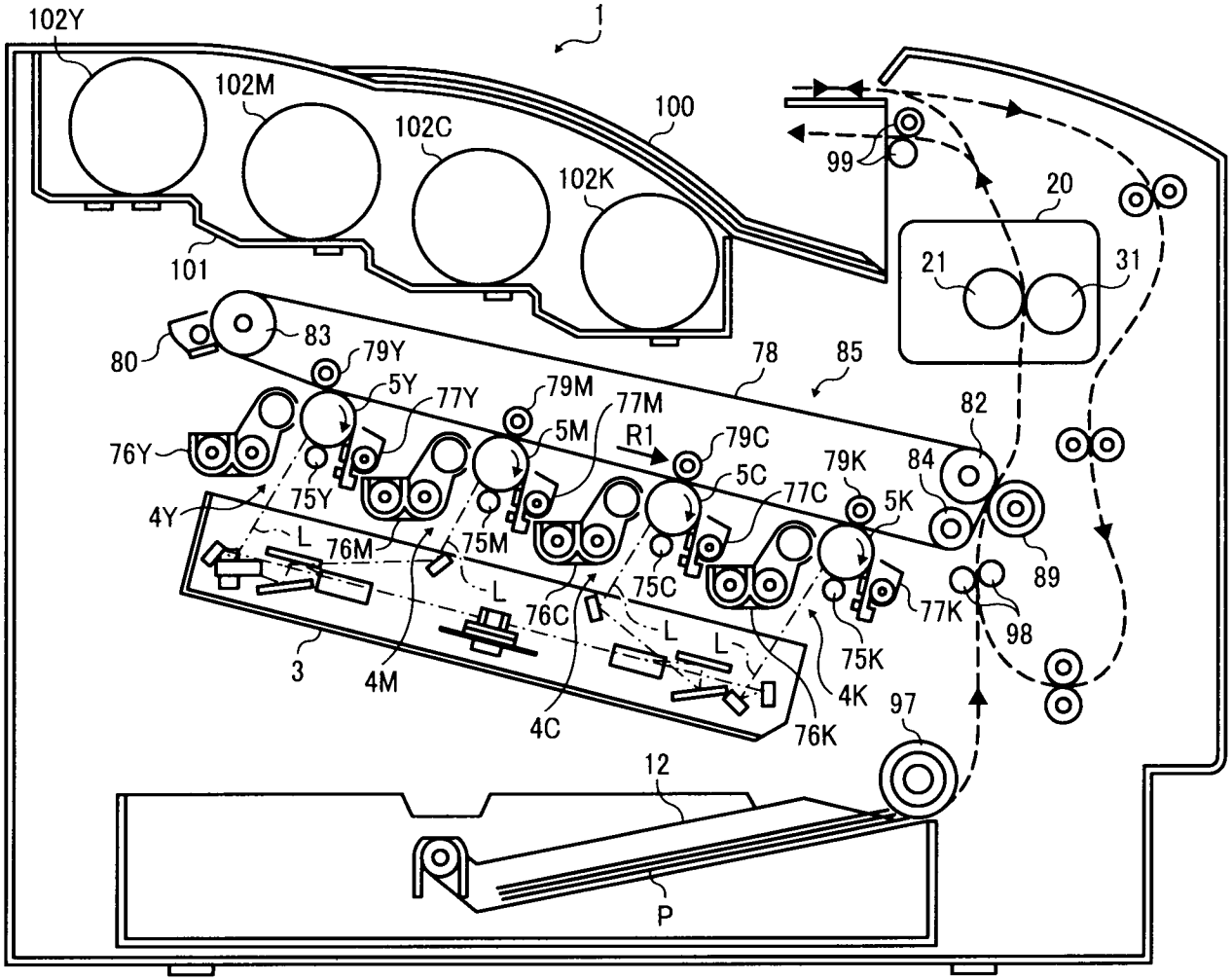
FIG. 3 is a schematic view of an image forming apparatus according to an exemplary embodiment of the present invention.

Referring now to the drawings, wherein like reference numerals designate identical or corresponding parts throughout the several views, in particular to FIG. 3, an image forming apparatus 1 according to an exemplary embodiment of the present invention is explained.

FIG. 3 is a schematic view of the image forming apparatus 1. As illustrated in FIG. 3, the image forming apparatus 1 may be a copier, a facsimile machine, a printer, a multifunction printer having at least one of copying, printing, scanning, plotter, and facsimile functions, or the like. According to this exemplary embodiment of the present invention, the image forming apparatus 1 is a tandem color printer for forming a color image on a recording medium by electrophotography or electrostatic recording.

As illustrated in FIG. 3, the image forming apparatus 1 includes an exposure device 3, image forming devices 4Y, 4M, 4C, and 4K, a paper tray 12, a fixing device 20, an intermediate transfer unit 85, a second transfer roller 89, a feed roller 97, a registration roller pair 98, an output roller pair 99, a stack portion 100, and a toner bottle holder 101.

The image forming devices 4Y, 4M, 4C, and 4K include photoconductive drums 5Y, 5M, 5C, and 5K, chargers 75Y, 75M, 75C, and 75K, development devices 76Y, 76M, 76C, and 76K, and cleaners 77Y, 77M, 77C, and 77K, respectively.

The fixing device 20 includes a fixing belt 21 and a pressing roller 31.

The intermediate transfer unit 85 includes an intermediate transfer belt 78, first transfer bias rollers 79Y, 79M, 79C, and 79K, an intermediate transfer cleaner 80, a second transfer backup roller 82, a cleaning backup roller 83, and a tension roller 84.

The toner bottle holder 101 includes toner bottles 102Y, 102M, 102C, and 102K.

The toner bottle holder 101 is provided in an upper portion of the image forming apparatus 1. The four toner bottles 102Y, 102M, 102C, and 102K contain yellow, magenta, cyan, and black toners, respectively, and are detachably attached to the toner bottle holder 101 so that the toner bottles 102Y, 102M, 102C, and 102K are replaced with new ones, respectively.

The intermediate transfer unit 85 is provided below the toner bottle holder 101. The image forming devices 4Y, 4M, 4C, and 4K are arranged opposite the intermediate transfer belt 78 of the intermediate transfer unit 85, and form yellow, magenta, cyan, and black toner images, respectively.

In the image forming devices 4Y, 4M, 4C, and 4K, the chargers 75Y, 75M, 75C, and 75K, the development devices 76Y, 76M, 76C, and 76K, the cleaners 77Y, 77M, 77C, and 77K, and dischargers surround the photoconductive drums 5Y, 5M, 5C, and 5K, respectively. Image forming processes including a charging process, an exposure process, a development process, a first transfer process, and a cleaning process are performed on the rotating photoconductive drums 5Y, 5M, 5C, and 5K to form yellow, magenta, cyan, and black toner images on the photoconductive drums 5Y, 5M, 5C, and 5K, respectively.

The following describes the image forming processes performed on the photoconductive drums 5Y, 5M, 5C, and 5K.

A driving motor drives and rotates the photoconductive drums 5Y, 5M, 5C, and 5K clockwise in FIG. 3. In the charging process, the chargers 75Y, 75M, 75C, and 75K uniformly charge surfaces of the photoconductive drums 5Y, 5M, 5C, and 5K at charging positions at which the chargers 75Y, 75M, 75C, and 75K are disposed opposite the photoconductive drums 5Y, 5M, 5C, and 5K, respectively.

In the exposure process, the exposure device 3 emits laser beams L onto the charged surfaces of the photoconductive drums 5Y, 5M, 5C, and 5K to irradiate and expose the charged surfaces of the photoconductive drums 5Y, 5M, 5C, and 5K, respectively, so as to form thereon electrostatic latent images corresponding to yellow, magenta, cyan, and black colors, respectively.

In the development process, the development devices 76Y, 76M, 76C, and 76K render the electrostatic latent images formed on the surfaces of the photoconductive drums 5Y, 5M, 5C, and 5K visible as yellow, magenta, cyan, and black toner images, respectively.

In the first transfer process, the first transfer bias rollers 79Y, 79M, 79C, and 79K transfer and superimpose the yellow, magenta, cyan, and black toner images formed on the photoconductive drums 5Y, 5M, 5C, and 5K onto the intermediate transfer belt 78. Thus, a color toner image is formed on the intermediate transfer belt 78.

After the transfer of the yellow, magenta, cyan, and black toner images, the surfaces of the photoconductive drums 5Y, 5M, 5C, and 5K from which the yellow, magenta, cyan, and black toner images are transferred reach positions at which the cleaners 77Y, 77M, 77C, and 77K are disposed opposite the photoconductive drums 5Y, 5M, 5C, and 5K, respectively. In the cleaning process, cleaning blades included in the cleaners 77Y, 77M, 77C, and 77K mechanically collect residual toner remaining on the surfaces of the photoconductive drums 5Y, 5M, 5C, and 5K from the photoconductive drums 5Y, 5M, 5C, and 5K, respectively. Thereafter, dischargers remove residual potential on the surfaces of the photoconductive drums 5Y, 5M, 5C, and 5K, respectively, thus completing a single sequence of image forming processes performed on the photoconductive drums 5Y, 5M, 5C, and 5K.

The following describes a series of transfer processes performed on the intermediate transfer belt 78.

The intermediate transfer unit 85 includes the endless, intermediate transfer belt 78, the four first transfer bias rollers 79Y, 79M, 79C, and 79K, the second transfer backup roller 82, the cleaning backup roller 83, the tension roller 84, and the intermediate transfer cleaner 80.

The intermediate transfer belt 78 is supported by and stretched over the second transfer backup roller 82, the cleaning backup roller 83, and the tension roller 84. The second transfer backup roller 82 drives and rotates the intermediate transfer belt 78 in a direction R1.

The first transfer bias rollers 79Y, 79M, 79C, and 79K and the photoconductive drums 5Y, 5M, 5C, and 5K sandwich the intermediate transfer belt 78 to form first transfer nips, respectively. The first transfer bias rollers 79Y, 79M, 79C, and 79K are applied with a transfer bias having a polarity opposite to a polarity of toner forming the yellow, magenta, cyan, and black toner images on the photoconductive drums 5Y, 5M, 5C, and 5K, respectively.

As the intermediate transfer belt 78 moves in the direction R1 and passes through the first transfer nips formed between the intermediate transfer belt 78 and the photoconductive drums 5Y, 5M, 5C, and 5K successively, the yellow, magenta, cyan, and black toner images formed on the photoconductive drums 5Y, 5M, 5C, and 5K, respectively, are transferred and superimposed onto the intermediate transfer belt 78 at the first transfer nips formed between the photoconductive drums 5Y, 5M, 5C, and 5K and the intermediate transfer belt 78. Thus, a color toner image is formed on the intermediate transfer belt 78.

The paper tray 12 is provided in a lower portion of the image forming apparatus 1, and loads a plurality of recording media P (e.g., transfer sheets). The feed roller 97 rotates counterclockwise in FIG. 3 to feed an uppermost recording medium P of the plurality of recording media P loaded on the paper tray 12 toward the registration roller pair 98.

The registration roller pair 98, which stops rotating temporarily, stops the uppermost recording medium P fed by the feed roller 97. For example, a roller nip of the registration roller pair 98 contacts and stops a leading edge of the recording medium P temporarily. The registration roller pair 98 resumes rotating to feed the recording medium P to a second transfer nip formed between the second transfer roller 89 and the intermediate transfer belt 78, as the color toner image formed on the intermediate transfer belt 78 reaches the second transfer nip.

After the first transfer process, an outer circumferential surface of the intermediate transfer belt 78 bearing the color toner image reaches a position at which the second transfer roller 89 is disposed opposite the intermediate transfer belt 78. At this position, the second transfer roller 89 and the second transfer backup roller 82 sandwich the intermediate transfer belt 78 to form the second transfer nip between the second transfer roller 89 and the intermediate transfer belt 78. At the second transfer nip, the second transfer roller 89 transfers the color toner image formed on the intermediate transfer belt 78 onto the recording medium P fed by the registration roller pair 98 in a second transfer process. After the second transfer process, when the outer circumferential surface of the intermediate transfer belt 78 reaches a position at which the intermediate transfer cleaner 80 is disposed opposite the intermediate transfer belt 78, the intermediate transfer cleaner 80 collects residual toner from the intermediate transfer belt 78, thus completing a single sequence of transfer processes performed on the intermediate transfer belt 78.

The recording medium P bearing the color toner image is sent to the fixing device 20. In the fixing device 20, the fixing belt 21 and the pressing roller 31 apply heat and pressure to the recording medium P to fix the color toner image on the recording medium P.

Thereafter, the fixing device 20 feeds the recording medium P bearing the fixed color toner image toward the output roller pair 99. The output roller pair 99 discharges the recording medium P onto an outside of the image forming apparatus 1, that is, the stack portion 100. Thus, the recording media P discharged by the output roller pair 99 are stacked on the stack portion 100 successively to complete a single sequence of image forming processes performed by the image forming apparatus 1.

Figure 4:
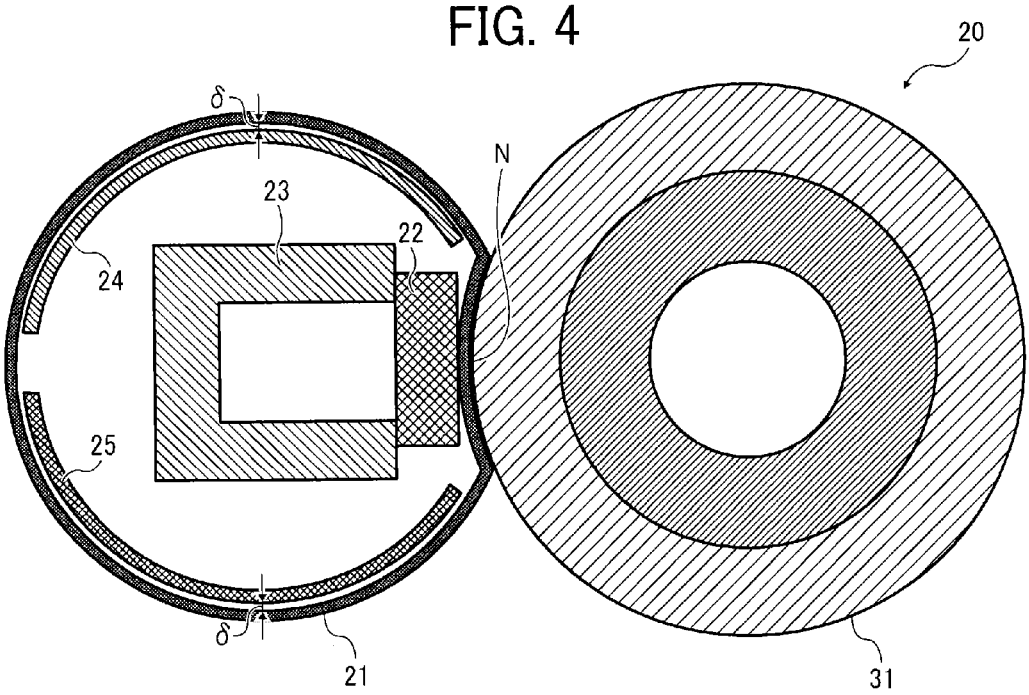
FIG. 4 is a sectional view of a fixing device included in the image forming apparatus shown in FIG. 3.
Figure 5:
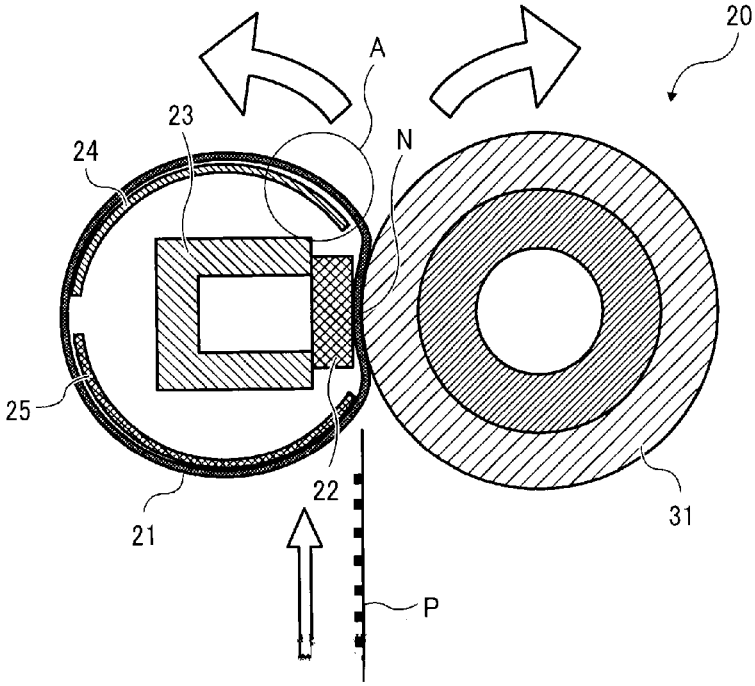
FIG. 5 is a sectional view of the fixing device shown in FIG. 4 when the fixing device is driven.

Referring to FIGS. 4 and 5, the following describes the structure of the fixing device 20.

FIG. 4 is a sectional view of the fixing device 20 when the fixing device 20 is not driven. FIG. 5 is a sectional view of the fixing device 20 when the fixing device 20 is driven. As illustrated in FIGS. 4 and 5, the fixing device 20 further includes a nip formation member 22, a support member 23, and heat generators 24 and 25.

As illustrated in FIGS. 4 and 5, in the fixing device 20, the fixing belt 21 (e.g., an endless belt) serves as a fixing member. The nip formation member 22 is pressed against the pressing roller 31 serving as a pressing member via the fixing belt 21. The support member 23 receives pressure applied by the pressing roller 31 via the nip formation member 22, and prevents deformation of the nip formation member 22. The heat generators 25 and 24 are arranged adjacent to each other inside a loop formed by the fixing belt 21 along an inner circumferential surface of the fixing belt 21, and serve as a first heat generator and a second heat generator for generating heat or heating members for heating the fixing belt 21, respectively. According to this exemplary embodiment, the two heat generators 24 and 25 are provided in the fixing device 20. Alternatively, three or more heat generators may be provided in the fixing device 20.

The pressing roller 31 presses against the nip formation member 22 disposed opposite the pressing roller 31 via the fixing belt 21 to form a fixing nip N. The support member 23 contacts a surface of the nip formation member 22 disposed opposite a nip formation surface facing the pressing roller 31. The support member 23 receives pressure applied by the pressing roller 31, and supports the nip formation member 22 to prevent the nip formation member 22 from being deformed substantially by pressure applied by the pressing roller 31.

The heat generators 24 and 25 face a non-nip portion of the inner circumferential surface of the fixing belt 21 other than a nip portion that forms the fixing nip N in such a manner that a slight gap $\delta$ is provided between the heat generator 24 and the fixing belt 21 and between the heat generator 25 and the fixing belt 21. According to this exemplary embodiment, the slight gap $\delta$ is greater than zero and not greater than 1 mm. Alternatively, the heat generators 24 and 25 may contact the non-nip portion of the inner circumferential surface of the fixing belt 21 by applying pressure not greater than a predetermined pressure to the fixing belt 21, for example, a pressure not greater than 0.3 $kgf/cm^2$.

According to this exemplary embodiment, each of the heat generators 24 and 25 is arc-shaped in cross-section. The two, separate heat generators 24 and 25 are arranged along a circumferential direction of the fixing belt 21 and extended in an axial direction of the fixing belt 21. A heat insulator may be provided between the nip formation member 22 and the support member 23 to reduce or prevent heat transmission from the nip formation member 22 to the support member 23 so as to prevent temperature decrease at the fixing nip N.

The heat generators 24 and 25 may be a sheet heat generator or a planar heat generator. For example, the heat generators 24 and 25 may be a resistance heat generator or an electromagnetic induction heater (IH) to heat the fixing belt 21 effectively in a short time.

Referring to FIGS. 4 and 5, the following describes operation of the fixing device 20 having the above-described structure.

When the image forming apparatus 1 depicted in FIG. 3 in which the fixing device 20 is installed receives an output signal, a driver (e.g., a motor) starts driving the pressing roller 31. Simultaneously, the heat generators 24 and 25 start heating the fixing belt 21. Alternatively, the heat generators 24 and 25 may not start heating in synchrony with driving of the driver, that is, may start heating at a staggered different time.

A driving force generated by the driver is transmitted to the pressing roller 31 by a transmission to drive and rotate the pressing roller 31. A rotation force of the pressing roller 31 is transmitted to the fixing belt 21 contacting the pressing roller 31. Thus, the fixing belt 21 starts rotating in accordance with rotation of the pressing roller 31.

When the fixing belt 21 is rotated as illustrated in FIG. 5, an upstream portion of the fixing belt 21 provided upstream from the fixing nip N in a direction of rotation of the fixing belt 21, that is, a recording medium conveyance direction, is tensioned. Accordingly, the inner circumferential surface of the fixing belt 21 slides over the heat generator 25 provided below the heat generator 24 in FIG. 5. The lower heat generator 25 contacts the fixing belt 21 to transmit heat generated by the lower heat generator 25 to the fixing belt 21 effectively.

By contrast, a downstream portion of the fixing belt 21 provided downstream from the fixing nip N in the recording medium conveyance direction is slacked. Accordingly, the heat generator 24 provided above the heat generator 25 in FIG. 5 does not contact the fixing belt 21 in a region A. To address this, the upper heat generator 24 is turned off or has a decreased temperature to prevent faulty temperature increase of a surface of the upper heat generator 24.

When the fixing belt 21 is heated up to a predetermined temperature, a recording medium P bearing a toner image is sent to the fixing device 20. While the recording medium P passes between the fixing belt 21 and the pressing roller 31, the fixing belt 21 and the pressing roller 31 apply heat and pressure to the recording medium P at the fixing nip P to fix the toner image on the recording medium P.

When the image forming apparatus 1 does not receive an output signal, the fixing device 20 is not driven in order to reduce power consumption. Accordingly, the fixing belt 21 is not rotated and the heat generators 24 and 25 are turned off. Alternatively, in order to resume a fixing operation quickly, the heat generators 24 and 25 may be powered on even when the fixing belt 21 is not rotated. Accordingly, the heat generators 24 and 25 may keep the entire fixing belt 21 warmed.

Figure 6:
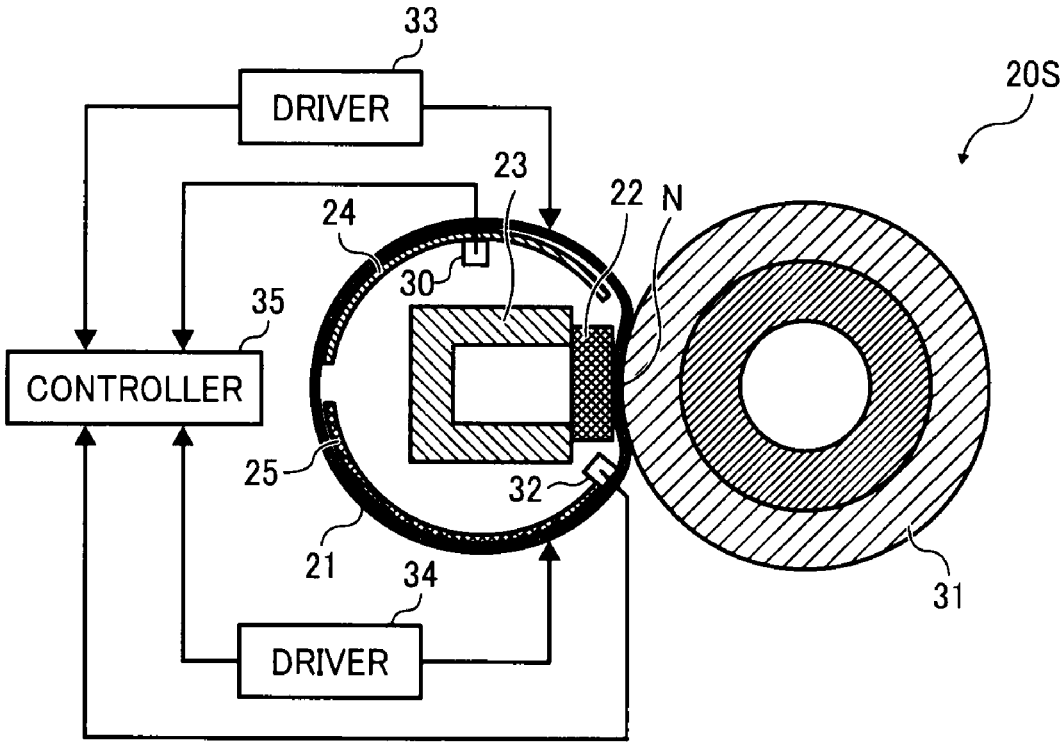
FIG. 6 is a sectional view of a fixing device according to another exemplary embodiment of the present invention.

FIG. 6 is a sectional view of a fixing device 20S according to another exemplary embodiment. As illustrated in FIG. 6, the fixing device 20S includes the fixing belt 21, the nip formation member 22, the support member 23, the heat generators 24 and 25, the pressing roller 31, temperature detectors 30 and 32, drivers 33 and 34, and a controller 35.

The fixing device 20S includes the elements that are also included in the fixing device 20 depicted in FIG. 4. Such elements are assigned reference numerals that are common to the fixing device 20, and descriptions of such elements are omitted.

The temperature detectors 30 and 32 (e.g., thermistors) correspond to the upper heat generator 24 and the lower heat generator 25, respectively. The drivers 33 and 34 drive the heat generators 24 and 25, respectively. Detection signals generated by the temperature detectors 30 and 32 are sent to the controller 35 serving as a temperature controller and including a central processing unit (CPU). The controller 35 controls the drivers 33 and 34 so that the drivers 33 and 34 turn on and off the heat generators 24 and 25 to control heat generation of the heat generators 24 and 25, respectively.

The temperature detector 32 is provided inside the fixing belt 21 at a position between the lower heat generator 25 and the fixing nip N in the direction of rotation of the fixing belt 21, and detects the temperature of the fixing belt 21 and the heat generator 25. The controller 35 controls the temperature of the heat generator 25 via the driver 34 based on a detection result provided by the temperature detector 32. Thus, the controller 35 controls the temperature inside the fixing nip N precisely when a recording medium P passes through the fixing nip N to receive heat from the fixing belt 21 at the fixing nip N.

When the lower heat generator 25 heats the fixing belt 21 while the fixing belt 21 does not rotate, the temperature of the lower heat generator 25 may increase excessively due to temperature control based on temperature detection of the fixing belt 21. To address this problem, a separate temperature detector may be provided to detect the temperature of the fixing belt 21 while the fixing belt 21 does not rotate. Further, when it is not necessary to control the temperature of the fixing belt 21 precisely while the fixing belt 21 rotates, the temperature detector 32 may be provided on the lower heat generator 25 to detect the temperature of the lower heat generator 25 both while the fixing belt 21 rotates and while the fixing belt 21 does not rotate.

The temperature detector 30 is provided inside the fixing belt 21 in such a manner that the temperature detector 30 faces an inner circumferential surface of the upper heat generator 24. The temperature detector 30 detects the surface temperature of the upper heat generator 24 so that the controller 35 controls the temperature of the fixing belt 21 while the fixing belt 21 does not rotate.

Figure 7A:
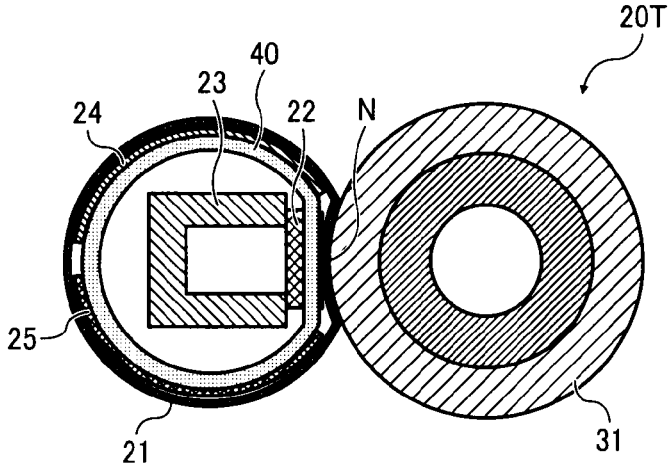
FIG. 7A is a sectional view of a fixing device according to yet another exemplary embodiment of the present invention at an end of the fixing device in an axial direction of a fixing belt included in the fixing device.
Figure 7B:
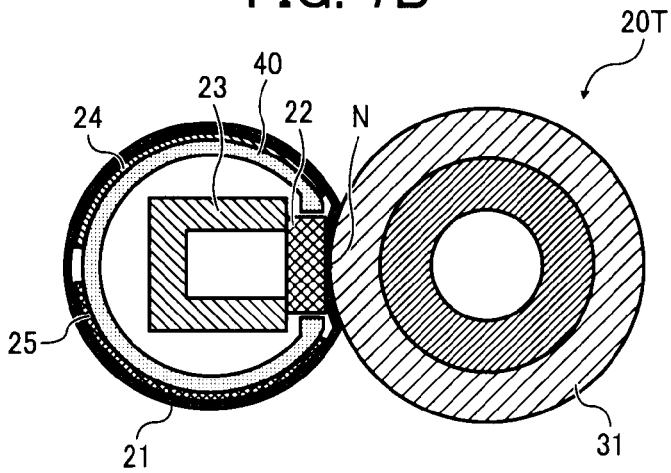
FIG. 7B is a sectional view of the fixing device shown in FIG. 7A at a center of the fixing device in the axial direction of the fixing belt.

Referring to FIGS. 7A and 7B, the following describes a fixing device 20T according to yet another exemplary embodiment. FIG. 7A is a sectional view of the fixing device 20T at an end of the fixing device 20T in the axial direction of the fixing belt 21. FIG. 7B is a sectional view of the fixing device 20T at a center of the fixing device 20T in the axial direction of the fixing belt 21. As illustrated in FIGS. 7A and 7B, the fixing device 20T includes a heat insulator 40. The other elements of the fixing device 20T are equivalent to the elements of the fixing device 20 depicted in FIG. 4.

The heat insulator 40 is provided inside a circle formed by the heat generators 24 and 25 in such a manner that the heat insulator 40 faces the inner circumferential surface of the heat generators 24 and 25 to suppress radiation of heat from the heat generators 24 and 25 toward the inside of the circle formed by the heat generators 24 and 25. Accordingly, heat is transmitted from the heat generators 24 and 25 to the fixing belt 21 effectively.

The heat insulator 40 is substantially pipe-shaped or substantially cylindrical to support the heat generators 24 and 25. Accordingly, the heat generators 24 and 25 may have decreased strength and smaller heat capacity. Consequently, the heat generators 24 and 25 can be heated more quickly.

Figure 8:
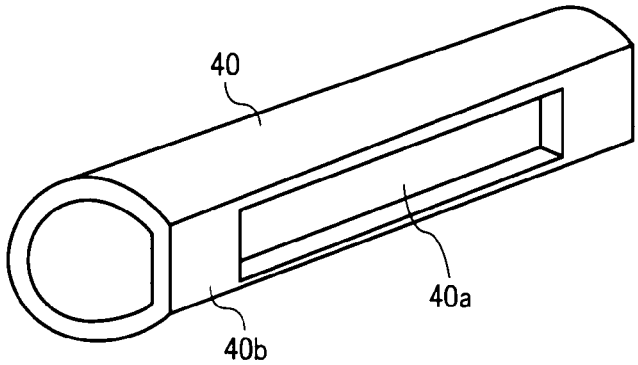
FIG. 8 is a perspective view of a heat insulator included in the fixing device shown in FIG. 7A.

FIG. 8 is a perspective view of the heat insulator 40. As illustrated in FIG. 8, the heat insulator 40 includes a slightly flattened side wall 40*b*. The side wall 40*b* includes an opening 40*a*. The heat insulator 40 is substantially pipe-shaped or substantially cylindrical, and includes the side wall 40*b* (e.g., a planar nip portion) facing the fixing nip N. In other words, a part of the heat insulator 40 is planar. The opening 40*a* is provided at a center portion of the side wall 40*b* in an axial direction of the heat insulator 40, which faces a recording medium conveyance region through which a recording medium P passes. The opening 40*a* penetrates the center portion of the side wall 40*b* in the axial direction of the heat insulator 40 in such a manner that the nip formation member 22 is provided in the opening 40*a*.

The heat insulator 40 is not fixedly supported by the nip formation member 22 and the support member 23, so that the nip formation member 22 is supported by the support member 23 only. Accordingly, when the pressing roller 31 presses against the nip formation member 22, the nip formation member 22 is elastically deformed but the heat insulator 40 is not elastically deformed.

In the fixing devices 20, 20S, and 20T according to the above-described exemplary embodiments, the pressing roller 31 is used as a pressing member. Alternatively, a pressing belt or a pressing pad may be used as a pressing member to provide effects equivalent to the effects provided by the pressing roller 31.

Further, the fixing belt 21, which may have a multi-layer structure, is used as a fixing member. Alternatively, an endless fixing film including polyimide resin, polyamide resin, fluorocarbon resin, or thin metal sheet may be used as a fixing member.

Referring to FIGS. 4, 6, and 7A, the following describes effects provided by the fixing devices 20, 20S, and 20T.

In a fixing device (e.g., the fixing device 20, 20S, 20T), a pressing member (e.g., the pressing roller 31) rotates in a predetermined direction of rotation. A flexible endless fixing member (e.g., the fixing belt 21) rotates in accordance with rotation of the pressing member. A nip formation member (e.g., the nip formation member 22) is provided inside a loop formed by the fixing member and pressed against the pressing member via the fixing member to form a nip (e.g., the fixing nip N) between the fixing member and the pressing member through which a recording medium bearing a toner image passes. A first heat generator (e.g., the heat generator 25) faces an inner circumferential surface of the fixing member at a position other than the nip to heat the fixing member. A second heat generator (e.g., the heat generator 24) faces the inner circumferential surface of the fixing member at a position other than the nip to heat the fixing member, and is disposed adjacent to the first heat generator along the inner circumferential surface of the fixing member.

With this configuration, the plurality of heat generators arranged along the inner circumferential surface of the fixing member is turned on and off to generate heat and not to generate heat according to conditions of each part of the fixing member so as to prevent abnormal temperature increase of a surface of the plurality of heat generators.

The first heat generator and the second heat generator contact the inner circumferential surface of the fixing member with a predetermined pressure not greater than 0.3 kgf/$cm^2$. Alternatively, the first heat generator and the second heat generator are disposed close to the fixing member with a predetermined gap not greater than 1 mm provided between the first heat generator and the fixing member and between the second heat generator and the fixing member.

The fixing member is substantially cylindrical. Each of the first heat generator and the second heat generator is arc-shaped. The arc-shaped second heat generator is disposed adjacent to the arc-shaped first heat generator along the inner circumferential surface of the substantially cylindrical fixing member.

A first temperature detector (e.g., the temperature detector 32) contacts the first heat generator to detect temperature of the first heat generator. A second temperature detector (e.g., the temperature detector 30) contacts the second heat generator to detect temperature of the second heat generator. A first driver (e.g., the driver 34) is connected to the first heat generator to drive the first heat generator. A second driver (e.g., the driver 33) is connected to the second heat generator to drive the second heat generator. A controller (e.g., the controller 35) is connected to the first temperature detector, the second temperature detector, the first driver, and the second driver to control the first driver based on a detection result provided by the first temperature detector and control the second driver based on a detection result provided by the second temperature detector.

With this configuration, the controller controls temperature distribution at any point in an entire circumferential direction of the fixing member The controller controls turning on and off of the first driver and the second driver according to rotation and non-rotation of the fixing member, so as to change heat generation distribution provided by the first heat generator and the second heat generator.

With this configuration, when the fixing member rotates, the controller causes the first heat generator contacting the fixing member to generate heat so as to prevent abnormal temperature increase of the second heat generator. By contrast, when the fixing member does not rotate, the controller causes the first heat generator and the second heat generator to generate heat so as to heat a region of the fixing member other than the fixing nip uniformly. Accordingly, the fixing device starts a fixing operation more quickly, and changes heat generation distribution as needed.

The first heat generator is provided upstream from the nip in the direction of rotation of the fixing member, and the controller turns on the first driver to drive the first heat generator when the fixing member rotates.

With this configuration, the controller causes the first heat generator provided at a position immediately before the nip at which the fixing member is adhered to the first heat generator easily to generate heat so as to transmit heat generated by the first heat generator to the fixing member more effectively.

The first temperature detector is provided between the first heat generator and the nip in the direction of rotation of the fixing member to detect temperature of the inner circumferential surface of the fixing member.

With this configuration, the controller controls driving of the first heat generator based on a detection result provided by the first temperature detector so as to adjust the temperature of the fixing member. Thus, the controller controls the temperature inside the nip precisely regardless of conveyance of the recording medium through the nip.

The second heat generator is provided downstream from the nip in the direction of rotation of the fixing member. The controller turns on the second driver to drive the second heat generator when the fixing member does not rotate. The second temperature detector contacts an inner circumferential surface of the second heat generator opposite an outer circumferential surface of the second heat generator facing the fixing member.

With this configuration, the second temperature detector is provided at a position at which the fixing member separates from the second heat generator to prevent abnormal temperature increase of the second heat generator.

A heat insulator (e.g., the heat insulator 40) is provided on an inner circumferential surface of the first heat generator and the second heat generator opposite an outer circumferential surface of the first heat generator and the second heat generator facing the fixing member.

With this configuration, the heat insulator causes heat generated by the first heat generator and the second heat generator to be transmitted to the fixing member more effectively.

The heat insulator supports the first heat generator and the second heat generator. With this configuration, the first heat generator and the second heat generator may have decreased strength. Further, the first heat generator and the second heat generator have decreased heat capacity, and therefore are heated quickly, saving energy.

The heat insulator is substantially cylindrical or substantially pipe-shaped to increase strength of the heat insulator at reduced costs.

A support member (e.g., the support member 23) contacts the nip formation member to support the nip formation member. The heat insulator is not fixed to the support member and the nip formation member. With this configuration, pressure applied by the pressing member to the nip formation member is not transmitted to the heat insulator, preventing deformation of the heat insulator.

The first heat generator and the second heat generator include one of a resistance heat generator and an electromagnetic induction heater.

An image forming apparatus (e.g., the image forming apparatus 1 depicted in FIG. 3) includes an image forming device (e.g., the image forming devices 4Y, 4M, 4C, and 4K depicted in FIG. 3) that forms a toner image on a recording medium and the fixing device having the above-described structure and configuration to fix the toner image on the recording medium. Accordingly, the image forming apparatus shortens warm-up time, saves energy, and forms a high quality image with stable fixing operation.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A fixing device comprising:

a pressing member to rotate in a predetermined direction of rotation;

a flexible endless fixing member to rotate in accordance with rotation of the pressing member;

a nip formation member provided inside a loop formed by the fixing member and pressed against the pressing member via the fixing member to form a nip between the fixing member and the pressing member through which a recording medium bearing a toner image passes;

a first heat generator facing an inner circumferential surface of the fixing member at a position other than the nip to heat the fixing member; and a second heat generator facing the inner circumferential surface of the fixing member at a position other than the nip to heat the fixing member, and disposed adjacent to the first heat generator along the inner circumferential surface of the fixing member, wherein:

the fixing member is substantially cylindrical, and each of the first heat generator and the second heat generator is arc-shaped both at an inwardly facing surface and an outwardly facing surface, the fixing device further comprising:

a first temperature detector contacting the first heat generator to detect temperature of the first heat generator;

a second temperature detector contacting the second heat generator to detect temperature of the second heat generator;

a first driver connected to the first heat generator to drive the first heat generator;

a second driver connected to the second heat generator to drive the second heat generator; and a controller connected to the first temperature detector, the second temperature detector, the first driver, and the second driver to control the first driver based on a detection result provided by the first temperature detector and control the second driver based on a detection result provided by the second temperature detector.

2. The fixing device according to claim 1, wherein the first heat generator and the second heat generator contact the inner circumferential surface of the fixing member with a predetermined pressure not greater than 0.3 $kgf/cm^2$.

3. The fixing device according to claim 1, wherein the first heat generator and the second heat generator are disposed close to the fixing member with a predetermined gap not greater than 1 mm provided between the first heat generator and the fixing member and between the second heat generator and the fixing member.

4. The fixing device according to claim 1, wherein:

the arc-shaped second heat generator is disposed adjacent to the arc-shaped first heat generator along the inner circumferential surface of the substantially cylindrical fixing member.

5. The fixing device according to claim 4, wherein:

the first heat generator is located at an opposite side of the nip as the second heat generator.

6. The fixing device according to claim 1, wherein the first heat generator and the second heat generator include one of a resistance heat generator and an electromagnetic induction heater.

7. The fixing device according to claim 1, wherein the controller controls turning on and off of the first driver and the second driver according to rotation and non-rotation of the fixing member.

8. The fixing device according to claim 7, wherein the first heat generator is provided upstream from the nip in the direction of rotation of the fixing member, and the controller turns on the first driver to drive the first heat generator when the fixing member rotates.

9. The fixing device according to claim 8, wherein the first temperature detector is provided between the first heat generator and the nip in the direction of rotation of the fixing member to detect temperature of the inner circumferential surface of the fixing member.

10. The fixing device according to claim 7, wherein the second heat generator is provided downstream from the nip in the direction of rotation of the fixing member, and the controller turns on the second driver to drive the second heat generator when the fixing member does not rotate, and wherein the second temperature detector contacts an inner circumferential surface of the second heat generator opposite an outer circumferential surface of the second heat generator facing the fixing member.

11. An image forming apparatus comprising:

an image forming device to form a toner image on a recording medium; and the fixing device according to claim 1.

12. The fixing device according to claim 1, wherein:

the first heat generator is located at an opposite side of the nip as the second heat generator.

13. A fixing device comprising:

a pressing member to rotate in a predetermined direction of rotation;

a flexible endless fixing member to rotate in accordance with rotation of the pressing member;

a nip formation member provided inside a loop formed by the fixing member and pressed against the pressing member via the fixing member to form a nip between the fixing member and the pressing member through which a recording medium bearing a toner image passes;

a first heat generator facing an inner circumferential surface of the fixing member at a position other than the nip to heat the fixing member; and a second heat generator facing the inner circumferential surface of the fixing member at a position other than the nip to heat the fixing member, and disposed adjacent to the first heat generator along the inner circumferential surface of the fixing member, wherein:

the fixing member is substantially cylindrical, and each of the first heat generator and the second heat generator is arc-shaped both at an inwardly facing surface and an outwardly facing surface, the fixing device further comprising a heat insulator provided on an inner circumferential surface of the first heat generator and the second heat generator opposite an outer circumferential surface of the first heat generator and the second heat generator facing the fixing member.

14. The fixing device according to claim 13, wherein the heat insulator supports the first heat generator and the second heat generator.

15. The fixing device according to claim 13, further comprising a support member to contact the nip formation member to support the nip formation member, wherein the heat insulator is not fixed to the support member and the nip formation member.

16. A fixing device comprising:

a pressing member to rotate in a predetermined direction of rotation;

a flexible endless fixing member to rotate in accordance with rotation of the pressing member;

a nip formation member provided inside a loop formed by the fixing member and pressed against the pressing member via the fixing member to form a nip between the fixing member and the pressing member through which a recording medium bearing a toner image passes;

a first heat generator facing an inner circumferential surface of the fixing member at a position other than the nip to heat the fixing member;

a second heat generator facing the inner circumferential surface of the fixing member at a position other than the nip to heat the fixing member, and disposed adjacent to the first heat generator along the inner circumferential surface of the fixing member; and a heat insulator provided on an inner circumferential surface of the first heat generator and the second heat generator opposite an outer circumferential surface of the first heat generator and the second heat generator facing the fixing member, wherein the heat insulator is substantially cylindrical.

* * * * *